US005509719A

United States Patent [19]

Cone, II

[11] Patent Number: 5,509,719

[45] Date of Patent: Apr. 23, 1996

[54] MULTI-POSITION CHAIR

[75] Inventor: Richard E. Cone, II, Athens, Ohio

[73] Assignee: Cosco, Inc., Columbus, Ind.

[21] Appl. No.: 334,248

[22] Filed: Nov. 4, 1994

[51] Int. Cl.[6] ..... A47C 3/20; A47C 1/02

[52] U.S. Cl. ..... 297/344.14; 297/344.18; 297/325; 297/327; 248/188.5

[58] Field of Search ..... 297/344.18, 325, 297/327, 328, 329, 256.13, 344.14; 248/188.5, 188.2, 440

[56] References Cited

U.S. PATENT DOCUMENTS

| | | | |
|---|---|---|---|
| D. 138,067 | 6/1944 | Morando | D15/8 |
| D. 147,540 | 9/1947 | Engelberg et al. | D15/1 |
| D. 207,779 | 5/1967 | Gunnell | D15/1 |
| 2,702,072 | 2/1935 | Shuessler | 297/328 |
| 2,973,804 | 3/1961 | Gill | 155/147 |
| 3,116,091 | 12/1963 | Bethoon et al. | 297/325 |
| 3,425,743 | 2/1969 | Peterson | 297/19 |
| 3,649,074 | 3/1972 | McDonald et al. | 297/153 |
| 4,181,356 | 1/1980 | Fleischer | 297/350 |
| 4,265,481 | 5/1981 | Fleischer | 297/30 |
| 4,344,649 | 8/1982 | Fleischer | 297/30 |
| 4,521,052 | 6/1985 | Cone | 297/3 |
| 4,603,902 | 8/1986 | Maloney | 297/35 |
| 4,723,813 | 2/1988 | Kassai | 297/153 |
| 4,962,965 | 10/1990 | Glover | 297/467 |
| 4,983,603 | 7/1990 | Turner et al. | 297/16 |
| 5,165,755 | 11/1992 | Rho | 297/345 |
| 5,183,310 | 2/1993 | Meeker et al. | 297/151 |
| 5,238,292 | 8/1993 | Golenz et al. | 297/153 |

OTHER PUBLICATIONS

Contemporary Flair Chair™ Instruction Sheet No. 4358–1959, Cosco (A Dorel Company), one page, 7 figures, date unknown.

Right Height™ (270195) and Celebrity™ High Chair (271181) Evenflo product advertisement, one page, date unknown.

Aprica Kassai U.S.A. Inc., Bed and Breakfast Model No. 251 Infant Seat/Cradle and High Chair Advertising Literature, two pages, date unknown.

Gerry 1994 Catalog, 385 Gerry® Adjust–a–Height® Chair, two pages.

Kolcarft 1994 Catalog, Kolcraft® Perfect Height™ Adjustable High Chair, four pages.

Playskool® Baby Care Products 1994 Catalog, 1–2–3 High Chair™, three pages.

Infantino 1994 Product Catalog, Futura Adjustable High Chair, three pages.

*Primary Examiner*—Peter M. Cuomo
*Assistant Examiner*—Anthony D. Barfield
*Attorney, Agent, or Firm*—Barnes & Thornburg

[57] ABSTRACT

A chair includes a multi-position seat and a frame assembly for supporting the seat in a selected position above a floor underlying the seat. The seat includes a seat bottom and a seat back positioned to lie adjacent to the seat bottom. The seat back is formed to include a guide channel receiving a portion of the frame assembly therein. The frame assembly includes a pedestal and a frame coupled to the pedestal and arranged to pass through, slide in, and pivot in the guide channel formed in the seat back. The frame assembly further includes at least one seat support link and a latch assembly. Each seat support link has one end pivotally coupled to the frame and another end pivotally coupled to the seat to allow the seat to be moved relative to the frame by a caregiver between selected positions. The latch assembly releasably couples the seat back to the frame to block pivoting and sliding movement of the frame in the guid channel and relative to the seat back and to block pivoting movement of each seat support link relative to the seat and frame.

14 Claims, 9 Drawing Sheets

MULTI-POSITION CHAIR

BACKGROUND AND SUMMARY OF THE INVENTION

The present invention relates to a multi-position chair, and particularly to a high chair for use by children. More particularly, the present invention relates to a youth chair having a fixed base and a seat that can be moved relative to the base to assume a selected elevation and orientation.

Traditionally, high chairs are used by caregivers to seat young children comfortably during a meal. As such, a conventional high chair includes a tray for holding food and beverages to be consumed by a child during a meal. A high chair tray can also be used to hold play toys or books provided by a caregiver to entertain a child seated in the high chair at times other than mealtime.

What is needed is a multi-position chair that is more versatile than a traditional high chair. Consumers would appreciate a youth chair that can function at mealtime as a traditional high chair yet can function at other times as a multi-position seat that is movable relative to its base to assume different elevations and orientations. Consumers would welcome a versatile child seat that could be raised or lowered to provide a high chair or a low chair and that could be placed in an upright position at mealtime or in one of several reclined positions at rest time.

According to the present invention, a chair includes a multi-position seat and a frame assembly for supporting the seat in a selected position above a floor underlying the seat. The seat includes a seat bottom and a seat back positioned to lie adjacent to the seat bottom. The seat back is formed to include a guide channel receiving a portion of the frame assembly therein.

The frame assembly includes a pedestal and a frame coupled to the pedestal and arranged to pass through, slide in, and pivot in the guide channel formed in the seat back. The frame assembly further includes at least one seat support link and a latch assembly. Each seat support link has one end pivotably coupled to the frame and another end pivotably coupled to the seat to allow the seat to be moved relative to the frame by a caregiver between selected positions. The latch assembly releasably couples the seat back to the frame to block pivoting and sliding movement of the frame in the guide channel and relative to the seat back and to block pivoting movement of each seat support link relative to the seat and frame.

In preferred embodiments, a caregiver can adjust the orientation of the seat relative to the frame by operating the latch assembly to release a locked connection between the seat and the frame and then moving the seat relative to the frame between an "upright" orientation and one or more "reclined" orientations. During such seat movement, the portion of the frame passing through the guide channel formed in the seat back pivots in and/or slides in the guide channel and each seat support link pivots about one pivot post appended to the frame and another pivot post appended to the seat.

Essentially, the seat, frame, and seat support links cooperate to define a multi-position linkage including several pivoting and one sliding joint. The latch assembly functions normally to hold this multi-position linkage in one of several available fixed positions to fix the orientation and position of the seat relative to the frame mounted on the pedestal. In use, a caregiver can operate the latch assembly to allow the frame to pivot and slide in the guide channel formed in the seat back so that the multi-position linkage is free to move to another of the several available fixed positions to change the orientation and position of the seat relative to the base.

Illustratively, the pedestal includes a base and a pair of spaced-apart upright chair legs mounted on the base and the frame is a somewhat U-shaped tubular member. The frame includes a first side arm slidably coupled in telescoping relation to a first of the upright chair legs, a second side arm slidably coupled in telescoping relation to a second of the upright chair legs, and a midsection bar interconnecting the first and second side arms and passing through the guide channel formed in the seat back. The elevation of the seat above the pedestal base is selected by placing a locking tab mounted on the distal end of each of the first and second side arms (and located inside the first and second chair legs) into one of the height-adjustment slots formed in each of the first and second upright chair legs.

The elevation of the seat can be changed in the following manner. Lowering of the seat toward the pedestal base is accomplished by tipping the seat slightly in a rearward direction so as to withdraw the locking tabs on the frame from the height-adjustment slots formed in the chair legs, lowering the seat to its new elevated position, and then inserting the locking tabs in the height-adjustment slots formed in the chair legs corresponding to the new elevated position. Raising of the seat above the pedestal base is accomplished by raising the seat toward its new position so that the locking tabs are cammed automatically out of the height-adjustment slots, then raising the seat further to position the locking tabs just above the destination height-adjustment slots and inserting the locking tabs in the height-adjustment slots.

Preferably, a frame mount assembly is appended to a rearwardly facing wall of the seat back and formed to include the guide channel. Illustratively, the frame mount assembly includes a pair of spaced-apart rails appended to the rearwardly facing wall and each of the rails is formed to include a vertical elongated bar-receiving slot therein. The two elongated bar-receiving slots are arranged to lie in spaced-apart relation to one another to define the guide channel and the midsection bar of the frame lies in perpendicular relation to the two rails and passes through the bar-receiving slots formed in the rails for sliding and pivoting movement therein.

The releasable latch assembly includes a latch arm mounted for rotation on the midsection bar of the frame and a spring for biasing a locking lug carried on the latch arm into engagement with one of several lug-receiving notches formed in the seat back upon arrival of the seat at one of the selected positions of the seat relative to the frame. Such engagement operates to fix the multi-position linkage in one of several available fixed positions to block movement of the seat relative to the frame mounted on the pedestal. Each lug-receiving notch is located to correspond with one of the selected orientations of the seat relative to the frame mounted on the pedestal. For example, three lug-receiving notches are provided in a preferred embodiment to facilitate placement of a movable multi-position seat in either an upright position, a partly reclined position, or a fully reclined position.

Illustratively, the latch assembly is positioned to lie between the pair of spaced-apart rails appended to the seat back and is configured to include a release handle coupled to the latch arm. To adjust the orientation of the seat relative to the frame on the pedestal, a caregiver simply grips the release handle and uses it to rotate the latch arm about the midsection bar of the frame to disengage the locking lug from one of the lug-receiving notches formed in the seat back. The caregiver can then move the seat to a selected orientation and then let go of the release handle so that the biasing spring in the latch assembly moves the latch arm to engage the locking lug in a lug-receiving notch corresponding to the new selected orientation.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
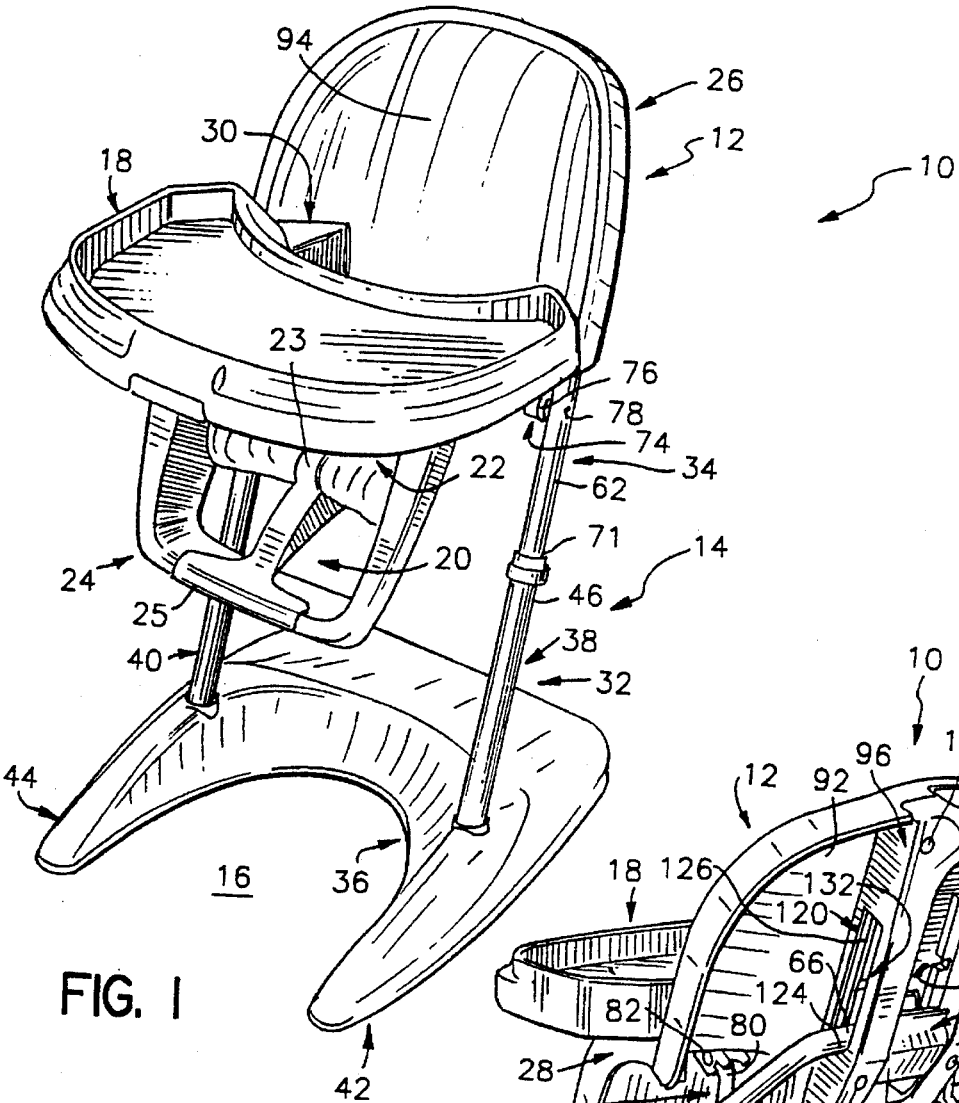
FIG. 1 is a front perspective view of a multi-position chair in accordance with the present invention.

A multi-position chair 10 is shown in FIG. 1. Chair 10 includes a seat. 12, a frame assembly 14 for supporting seat 12 above floor 16, a removable tray 18, and a pivotable child-restraint bar 20. Seat 12 includes a seat bottom 22, a footrest 24 positioned to lie forward of and below seat bottom 22, a seat back 26 positioned to lie along a rear edge of seat bottom 22, and a pair of side arms 28, 30 positioned to lie on opposite sides of seat bottom 22.

Tray 18 is configured to be mounted easily on side arms 28, 30 of seat 12. Reference is hereby made to U.S. Patent Application entitled "Child Seat Tray Assembly," incorporated by reference herein and filed on Nov. 4, 1994, by Richard E. Cone, II for a description of a tray suitable for use in chair 10.

Child-restraint bar 20 is pivotable between a down-out-of-the-way stored position shown in FIG. 1 lying below seat bottom 22 and an upright use position (not shown) extending above seat bottom 22 to help retain a child (not shown) in a seated position in seat 12. Child-restraint bar 20 is T-shaped and includes a base 23 that is pivotably coupled to a front edge of seat bottom 22 and a transverse cross member 25 that fits onto footrest 24 when the child-restraint bar 20 occupies its down-out-of-the-way position as shown in FIG. 1. Reference is hereby made to U.S. Patent Application entitled "Child Restraint Apparatus for a Child Seat," incorporated by reference herein and filed on Nov. 4, 1994, by Richard E. Cone, II for a description of a child-restraint bar suitable for use in chair 10.

Figure 2:
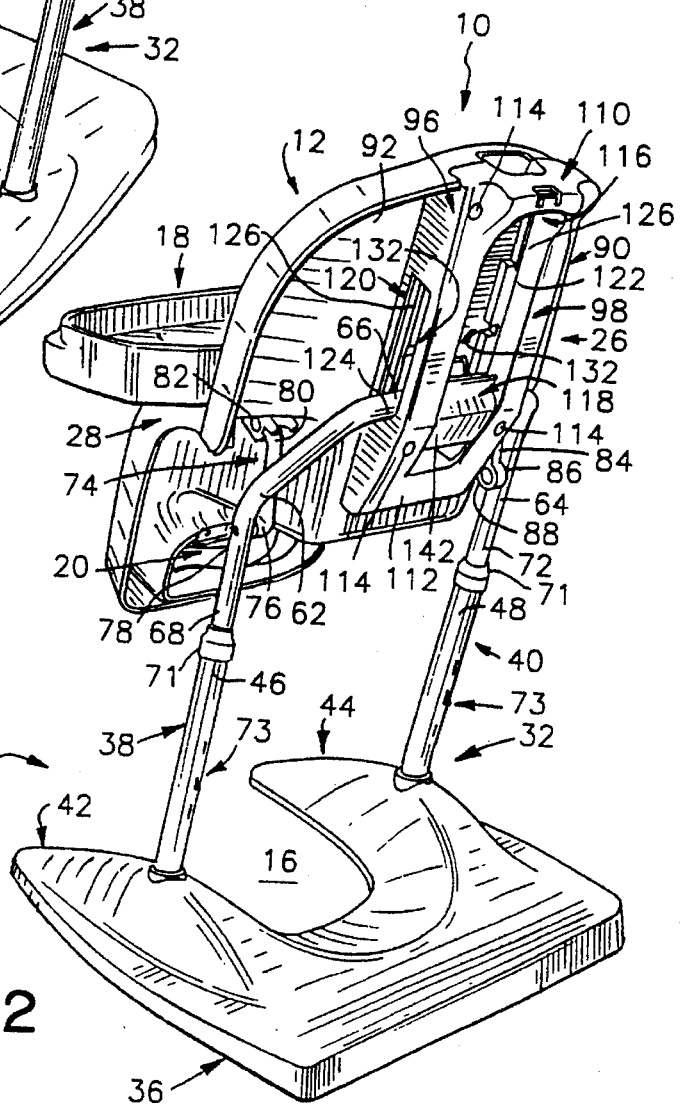
FIG. 2 is a rear perspective view of the chair of FIG. 1 showing a pedestal including a base and two upright chair legs, a U-shaped tubular frame coupled to the upright chair legs, a seat, left-side and right-side seat support links pivotably connected at one end to the frame and at another end to the seat, a box-shaped rectangular frame mount assembly appended to a rear wall on the seat back and formed to include a pair of spaced-apart vertical slots receiving a midsection bar of the U-shaped frame, and a rotatable latch assembly coupled to the midsection bar and positioned to lie in the frame mount assembly.

Frame assembly 14 includes a pedestal 32 and a frame 34 mounted on pedestal 32 as shown in FIGS. 1 and 2.

Illustratively, frame 34 is mounted for sliding movement on pedestal 32 so that it can be raised and lowered on pedestal 32 to change the elevation of seat 12 above floor 16 at the option of the caregiver.

Pedestal 32 includes a generally U-shaped base 36 and a pair of upright chair legs 38, 40 mounted on forwardly extending prongs 42, 44 of base 36 as shown in FIGS. 1 and 2. Chair legs 38, 40 are elongated tubular members that are arranged to lie in spaced-apart parallel relation and terminate at tips 46, 48. Chair legs 38, 40 are oriented to lie at an acute angle 41 to floor 16 as shown best, for example, in FIG. 4. Illustratively, base 36 is a molded shell made of plastics material having an underside as shown in FIG. 3.

Figure 3:
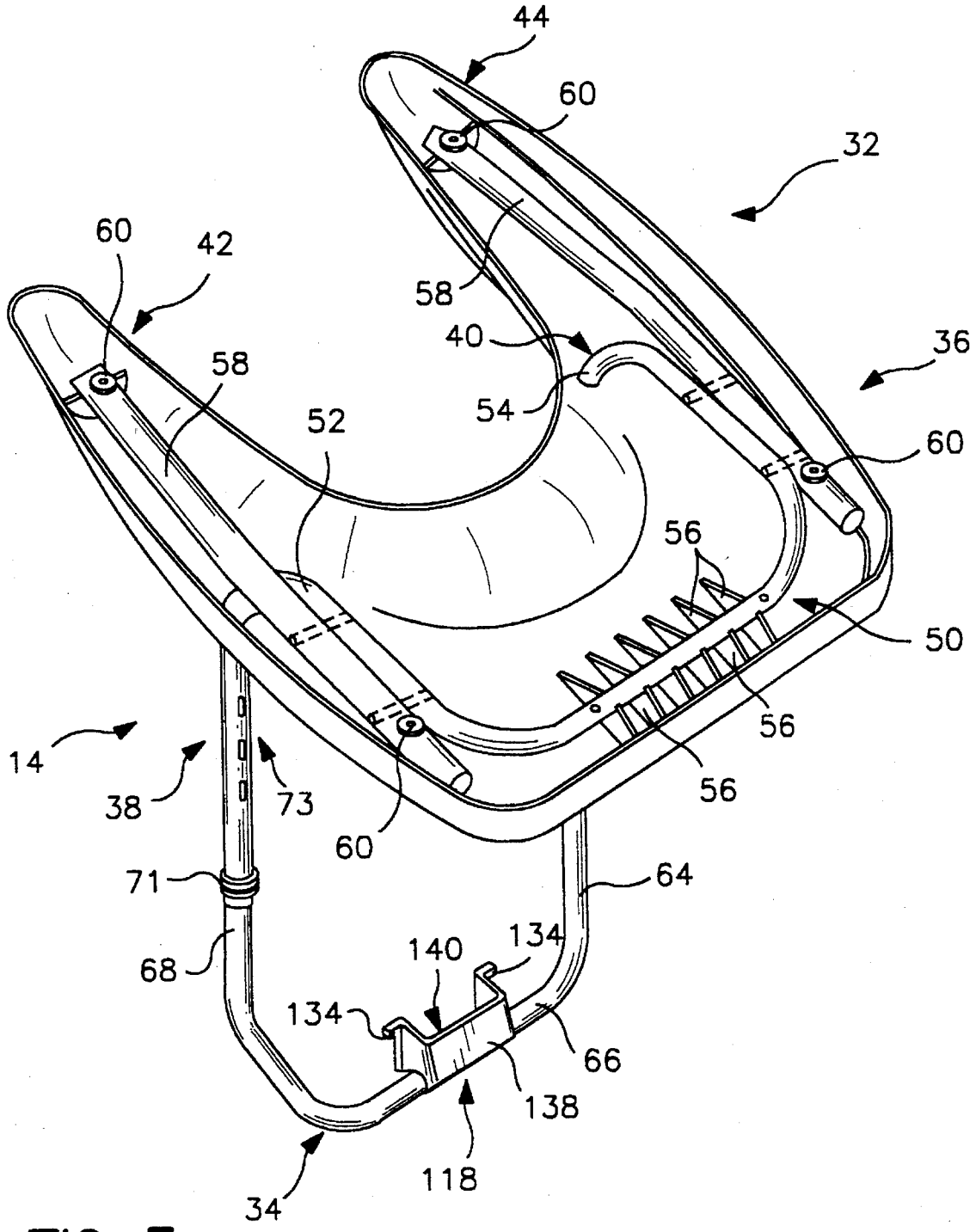
FIG. 3 is a perspective view of a subassembly of various components shown in FIG. 2, which subassembly comprises the pedestal, the U-shaped frame coupled to the pedestal, and the rotatable latch assembly coupled to the midsection bar of the U-shaped frame.

Further, as shown best in FIG. 3, chair legs 38, 40 are illustratively made of a single metal tubular member having a U-shaped bight section 50 interconnecting lowermost ends 52, 54 of chair legs 38, 40 and oriented on base 36 by means of guides 56. Bight section 50 is hidden from view by base 36 during use of chair 10. In addition, a pair of bottom rails 58 provided with floor pads 60 are mounted in cavities formed on the underside of forwardly extending prongs 42, 44 in base 36 and attached to U-shaped bight section 50 as shown in FIG. 3.

Figure 13:
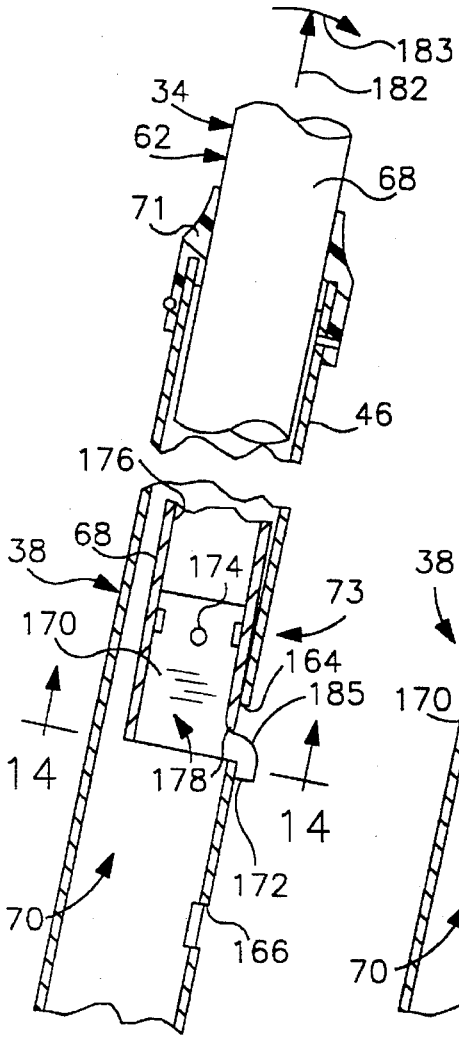
FIG. 13 is a longitudinal sectional view taken along line 13—13 of FIG. 12 showing the first frame side arm in telescoping relation inside a passageway formed in the first upright chair leg and showing engagement of a locking tab carried on the lowermost end of the first frame side arm in a height adjustment slot formed in the cylindrical outer wall of the upright chair leg.

Frame 34 includes a generally U-shaped bent metal tubular member including an elbow-shaped first side arm 62, an elbow-shaped second side arm 64, and a straight midsection bar 66 interconnecting the first and second side arms 62, 64 as shown in FIGS. 2 and 3. Frame 34 is generally U-shaped and is mounted to chair legs 38, 40 for sliding movement therein so that a caregiver can raise or lower seat 12 by raising or lowering frame 34 on pedestal 32. First side arm 62 has a distal end 68 that is telescopically received in a passageway 70 provided inside first chair leg 38 as shown in FIGS. 2 and 13. Likewise, second side arm 64 has a distal end 72 that is telescopically received in a passageway (not shown) inside second chair leg 40 as shown in FIG. 2.

Figure 15:
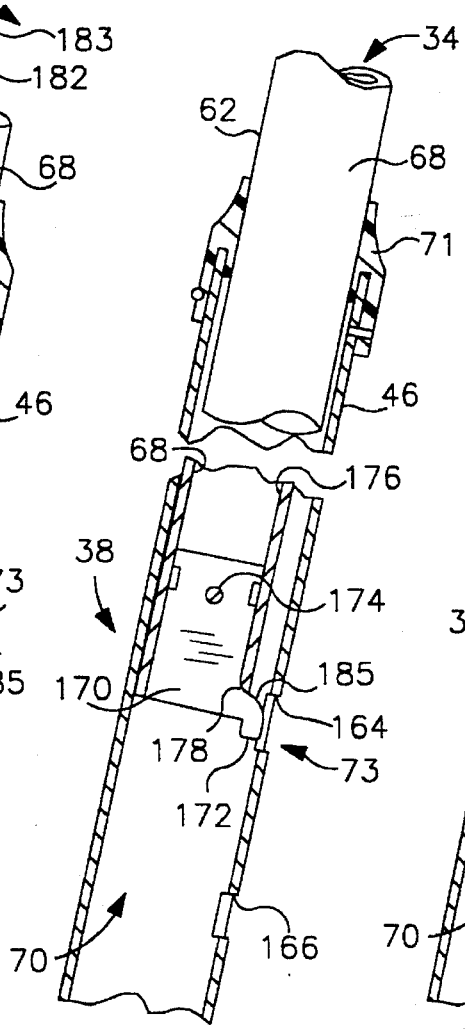
FIG. 15 is a view similar to FIG. 13 showing disengagement of the locking tab from the height-adjustment slot following pivoting of the frame side arm relative to its companion upright chair leg about a pivot axis that is perpendicular to the frame side arm.
Figure 16:
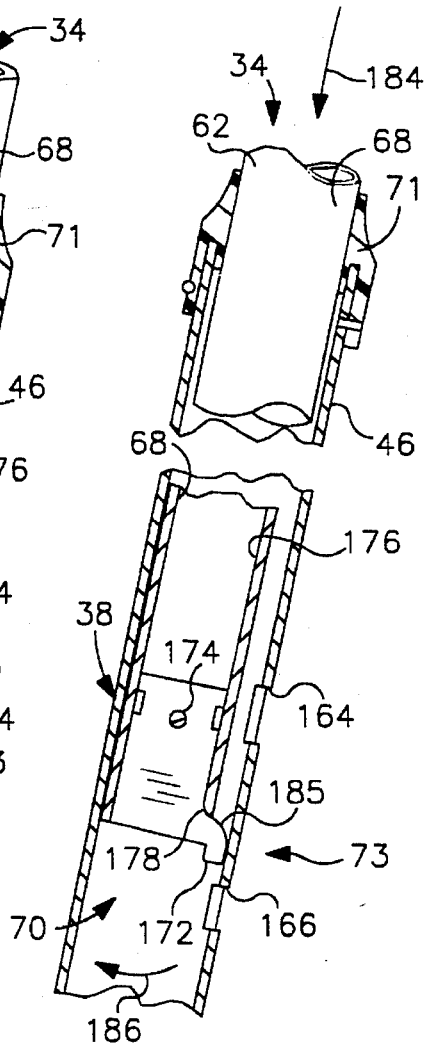
FIG. 16 is a view similar to FIGS. 13 and 15 showing lowering of the frame side arm inside the passageway formed in its companion upright chair leg.
Figure 14:
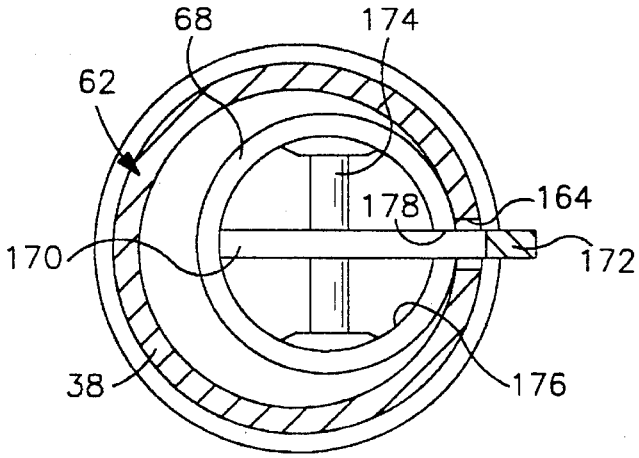
FIG. 14 is a transverse sectional view taken along line 14—14 of FIG. 13 showing engagement of a locking tab in a height-adjustment slot.

A collar 71 is mounted (as shown in FIG. 2) at the junction of (a) first side arm 62 and first chair leg 38 and (b) second side arm 64 and second chair leg 40 to guide and support sliding movement of side arms 62, 64 in chair legs 38, 40 in the manner shown, for example, in FIGS. 13, 15, and 16. Elevation locking means 73 for selectively fixing first side arm 62 in a fixed position inside first chair leg 38 and for selectively fixing second side arm 64 in a fixed position inside second chair leg 40 to hold frame 34 in a fixed position on pedestal 32 is discussed below and shown, for example, in FIGS. 2 and 12–16.

Figure 4:
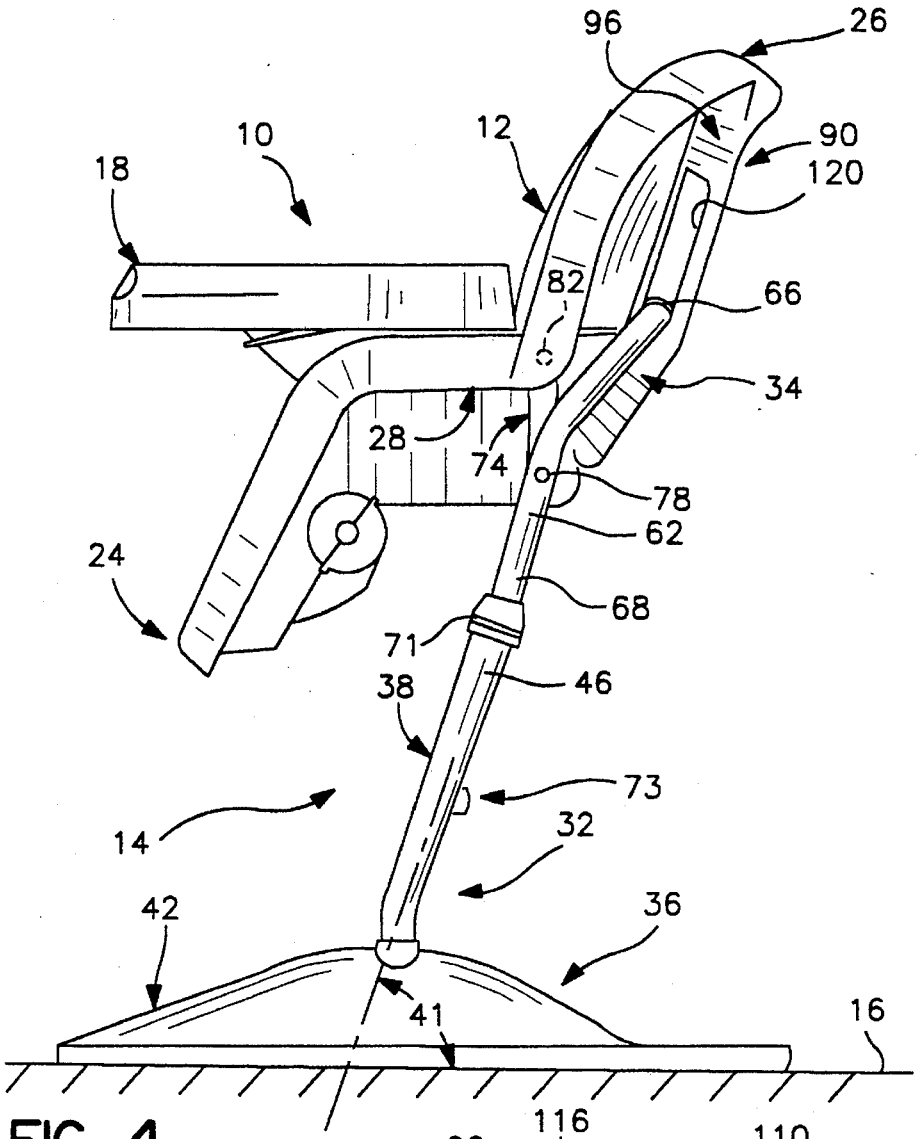
FIG. 4 is a side elevation view of the multi-position chair of FIG. 1 showing the seat in an "upright" position.
Figure 6:
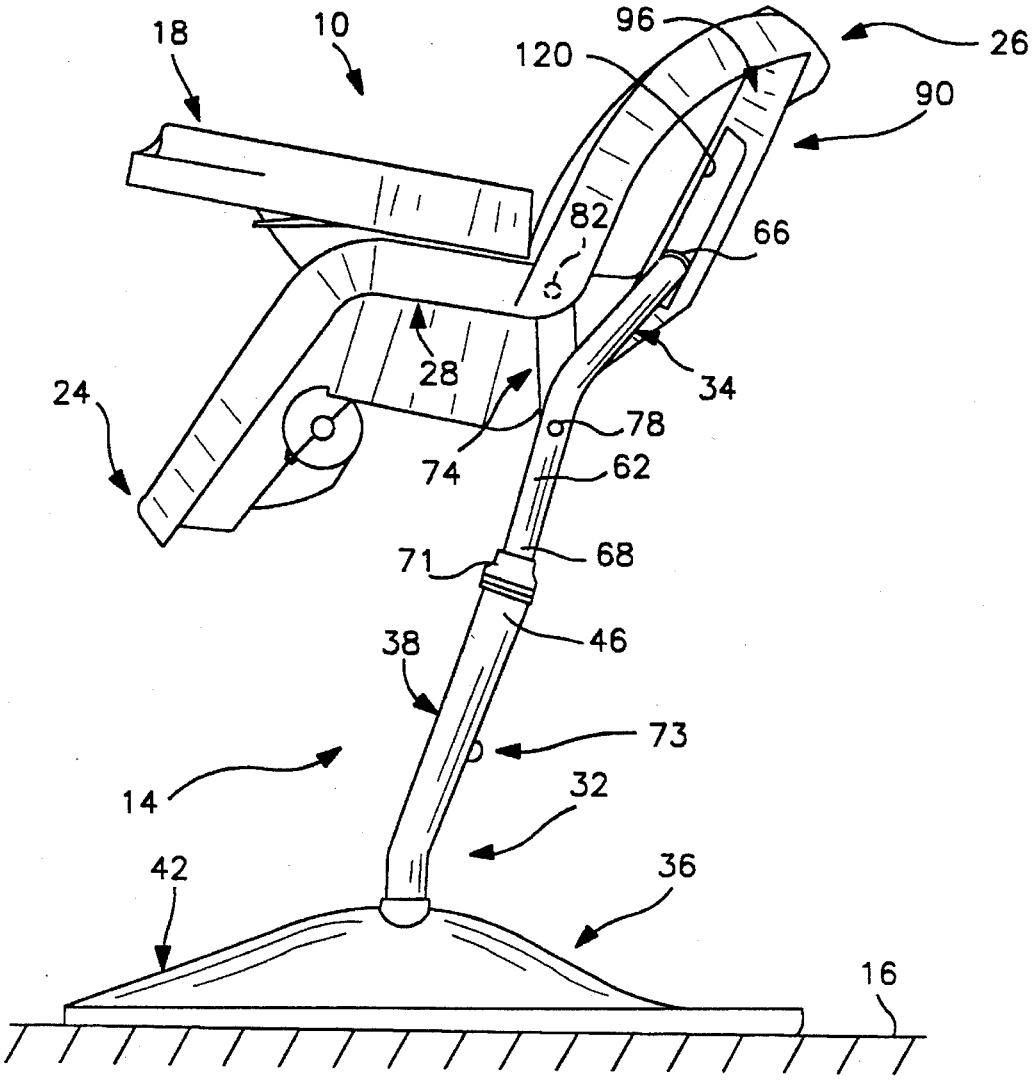
FIG. 6 is a side elevation view of the multi-position chair of FIG. 1 showing the seat after it has been tilted to a "mid-range" position.
Figure 8:
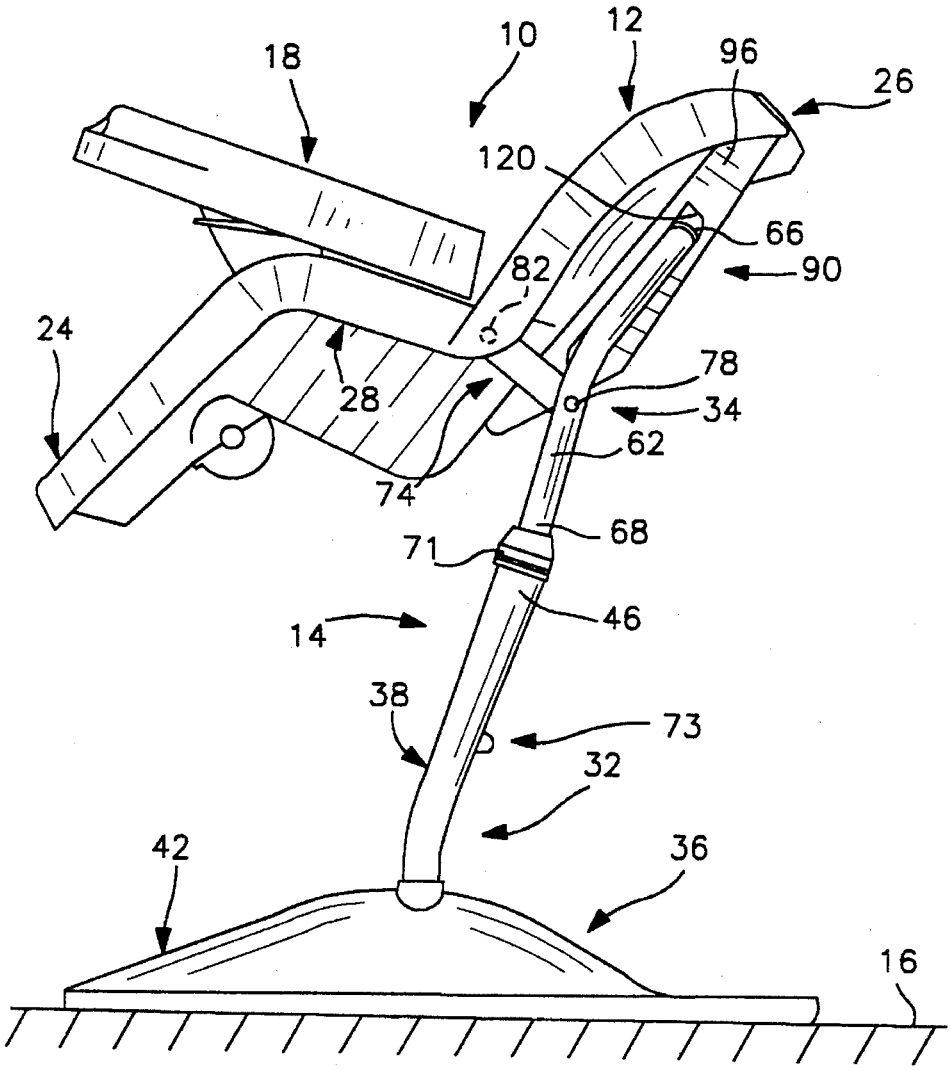
FIG. 8 is a side elevation view of the multi-position chair of FIG. 1 showing the seat after it has been tilted further to a "fully reclined" position.

First and second seat support links 74, 76 are provided for controlling movement of seat 12 relative to frame 34 as a caregiver changes the orientation of seat 12 in the manner shown, for example, in FIGS. 4, 6, and 8. First seat support link 74 includes one end 76 pivotably coupled to a first pivot post 78 mounted on first side arm 62 and another end 80 pivotably coupled to a second pivot post 82 mounted on seat back 26 as shown, for example, in FIG. 2. Second seat support link 84 is similar in shape and function to first support link 74 and includes one end 86 pivotably coupled to a first pivot post 88 mounted on second side arm 64 and another end (not shown but like end 80) pivotably coupled to a second pivot post (not shown but like post 82) mounted on seat back 20.

Frame mount assembly 90 is appended to a rearwardly facing wall 92 of seat back 26 so as to lie behind a forwardly facing backrest wall 94 of seat back 26 as shown best with reference to FIGS. 1 and 2. Frame mount assembly 90 includes a first rail 96, a second rail 98 aligned to lie in spaced-apart parallel relation to first rail 96, and a pair of spaced-apart parallel cross members 110, 112 connecting adjacent ends of rails 96, 98 as shown in FIG. 2. Frame mount assembly 90 is a generally rectangular, somewhat box-shaped appendage provided on the rear wall 92 of seat back 26 and configured to provide a laterally extending guide channel on seat back 26 for controlling pivoting and sliding movement of frame 34 during a change in orientation of seat 12 relative to frame 34 on pedestal 32. Illustratively, frame mount assembly 90 is a molded shell made of plastics material that is held in place on rear wall 92 of seat back 26 using several connectors 114 as shown in FIG. 2. Frame mount assembly 90 is also formed to include an elongated, rectangle-shaped central opening 116 shown, for example, in FIG. 2 for receiving a pivotable latch assembly 118 that is operable either to lock frame 34 to seat back 26 or unlock frame 34 from seat back 26.

Figure 5:
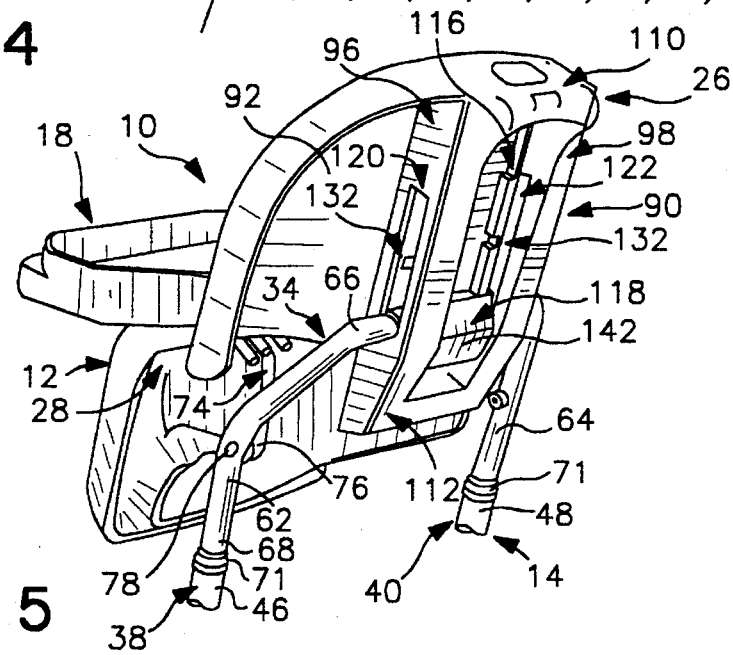
FIG. 5 is a rear perspective view of a portion of the chair shown in FIG. 4 and showing a multi-position "linkage" comprising the U-shaped frame, the seat, and two seat support links positioned to lie on opposite sides of the seat and coupled for pivotable movement to each of the seat and the U-shaped frame.
Figure 7:
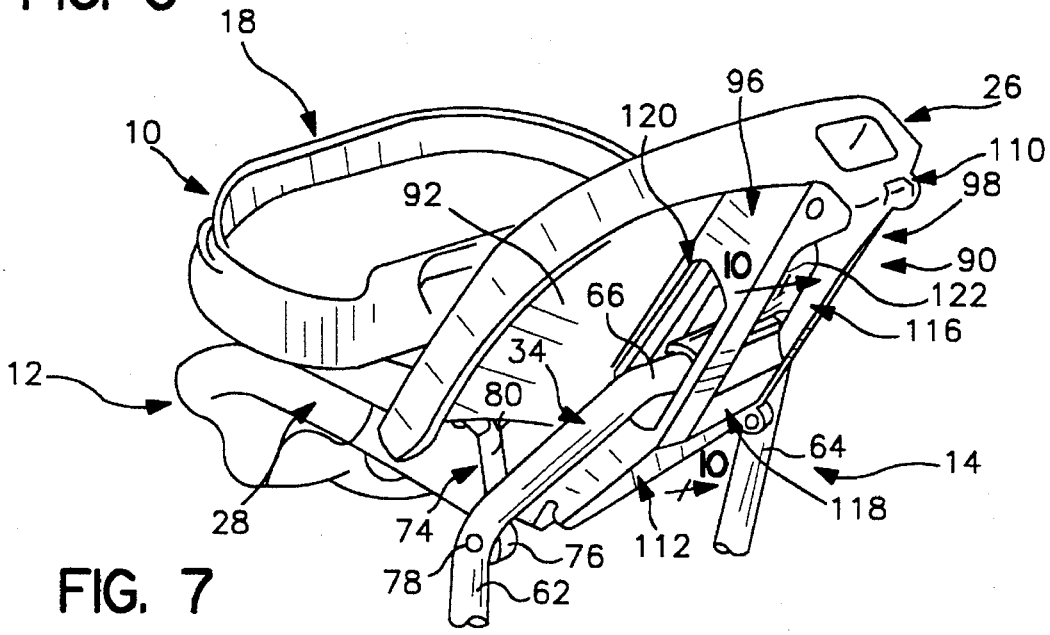
FIG. 7 is a rear perspective view of a portion of the chair shown in FIG. 6.
Figure 9:
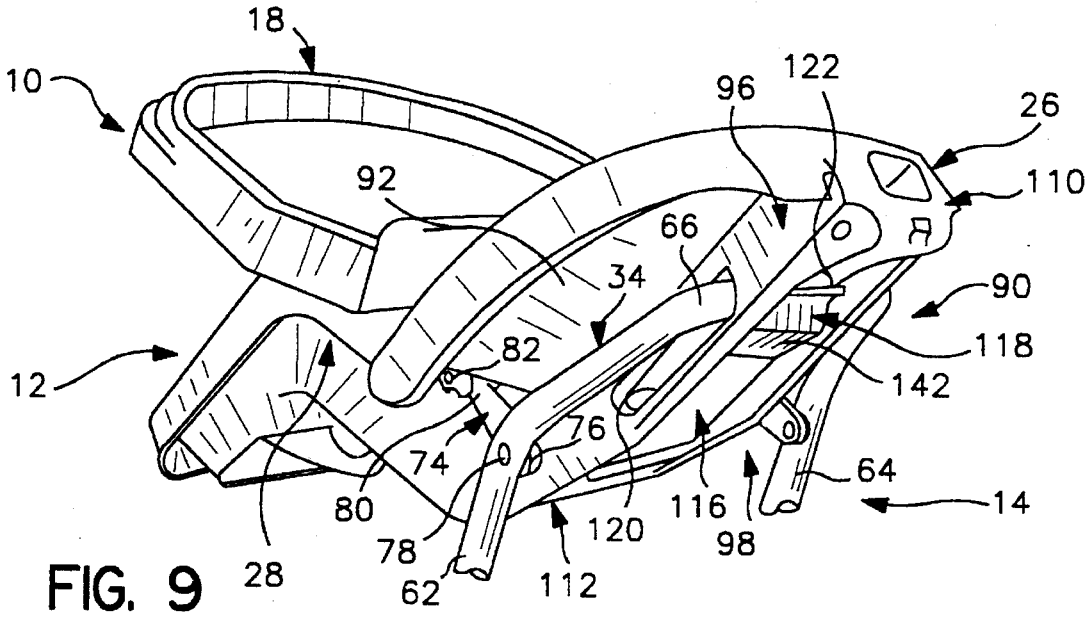
FIG. 9 is a rear perspective view of a portion of the chair shown in FIG. 8.

Each of the rails 96, 98 is formed to include a longitudinally extending, bar-receiving slot for receiving the straight midsection bar 66 of U-shaped frame 34 therein. First rail 96 is formed to include bar-receiving slot 120 as shown, for example, in FIG. 2, and second rail 96 is formed to include bar-receiving slot 122 as shown, for example, in FIGS. 2, 10, and 11. Midsection bar 66 passes through first and second bar-receiving slots 120, 122. Illustratively, midsection bar 66: (a) engages end wall 124 bordering a lower portion of each slot 120, 122 when seat 12 is oriented in its upright position as shown in FIGS. 2, 4, and 5; (b) engages an upper end wall 126 bordering an upper portion of each slot 120, 122 when seat 12 is oriented in its fully reclined position as shown in FIGS. 8 and 9; and (c) lies midway between lower and upper end walls 124, 126 when seat 12 is oriented in its mid-range position as shown in FIGS. 6 and 7. These lower and upper end walls 124, 126 serve as stops to limit sliding movement of seat 12 relative to frame 34 on pedestal 32 during reorientation of seat 12 to a selected new position.

Each of rails 96, 98 is also formed to include a plurality of lug-receiving notches positioned to lie in central opening 116 formed in frame mount assembly 90 and arranged to engage latch assembly 118 so as to establish one of the selected positions of seat 12 relative to frame 34 on pedestal 32. In the illustrated embodiment, each of rails 96, 98 is formed to include three notches 128, 130, 133 that are arranged to extend longitudinally in spaced-apart relation as shown, for example, in FIGS. 2, 10, and 11. Lower notch 128 in each of rails 96, 98 receives a locking lug 134 on latch assembly 118 to establish the upright position of seat 12 shown in FIGS. 2, 4, and 5. Middle notch 130 in each of rails 96, 98 receives locking lug 134 to establish the mid-range position of seat 12 shown in FIGS. 6 and 7. Finally, upper notch 132 in each of rails 96, 98 receives locking lug 134 to establish the fully reclined position of seat 12 shown in FIGS. 8 and 9. It is within the scope of the invention to form these lug-receiving notches in seat back 26 or in some appendage to seat back 26 other than rails 96, 98 so that the latch assembly 118 is movable to engage and disengage the notches to fix or release seat 12 to or from frame 34. Further, the number and position of the lug-receiving notches can be varied to vary the preset orientation positions of seat 12 available to a caregiver using multi-position chair 10.

Figure 10:
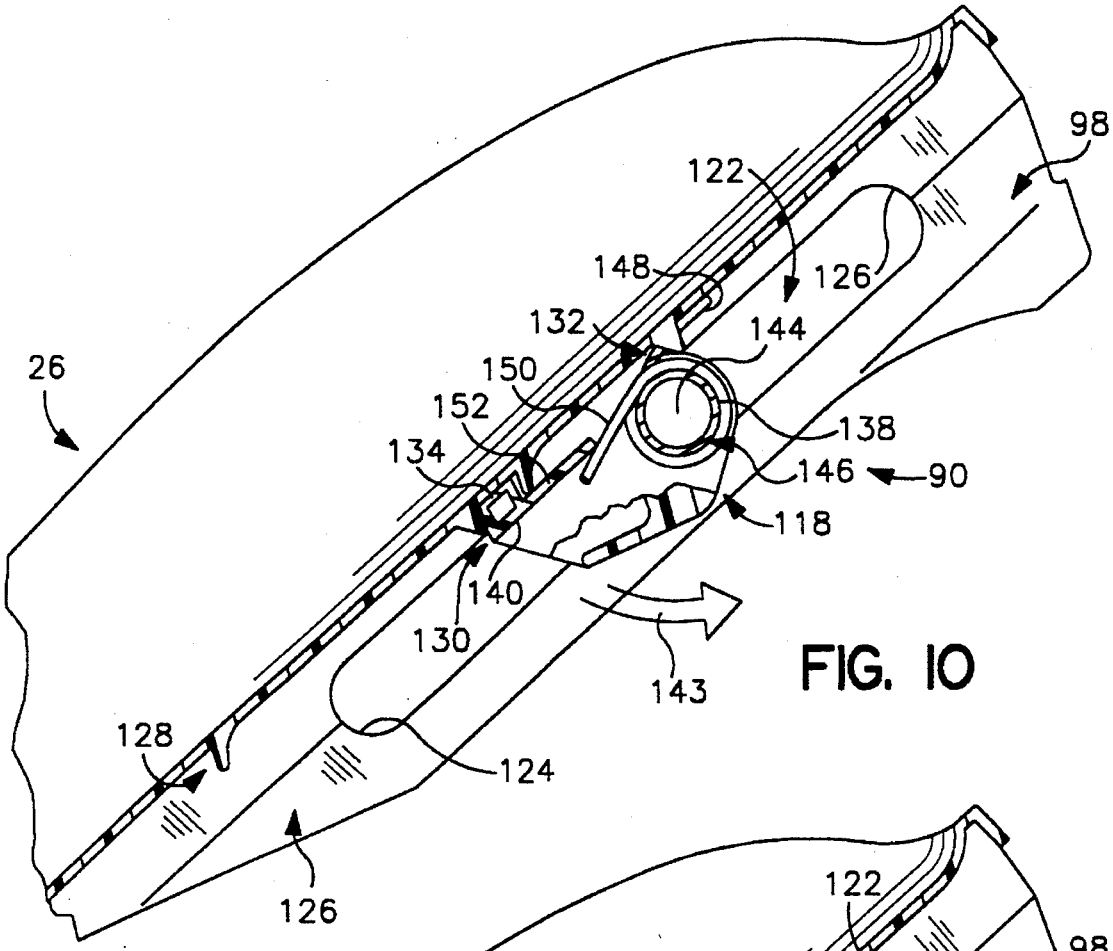
FIG. 10 is a sectional view taken along line 10—10 of FIG. 7 showing a latch assembly positioned to lock the seat to the frame and showing a latch arm mounted for rotation on the midsection bar of the frame and carrying a locking lug that is spring-biased into engagement with one of the three lug-receiving notches formed in a member appended to the rear wall of the seat back to establish the mid-range position of the seat shown in FIG. 6.
Figure 11:
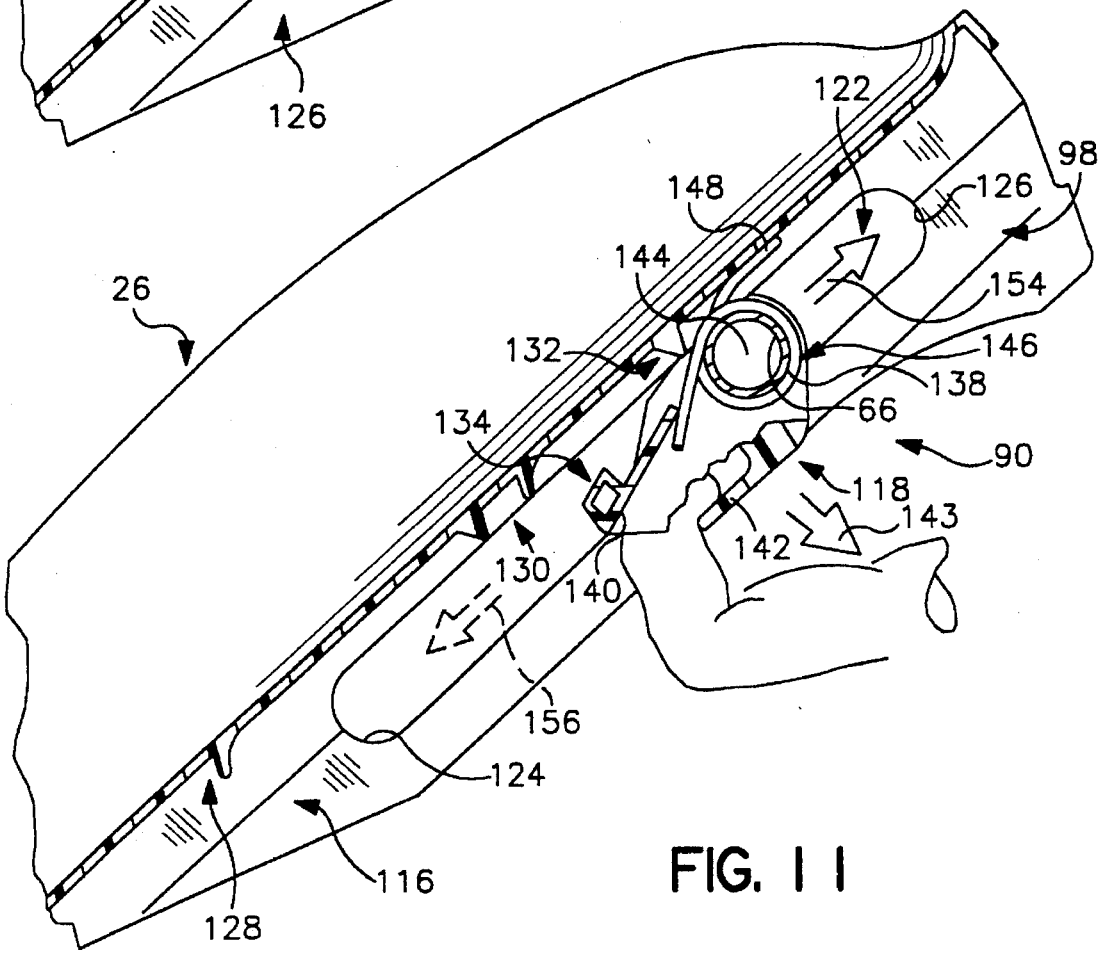
FIG. 11 is a view similar to FIG. 10 showing a caregiver gripping and rotating a release handle appended to the latch arm to disengage the locking lug from the mid-range lug-receiving notch so that the caregiver can move the seat relative to the frame mounted on the pedestal from the mid-range position shown in FIG. 6 to either one of the upright position shown in FIG. 4 or the fully reclined position shown in FIG. 8.
Figure 12:
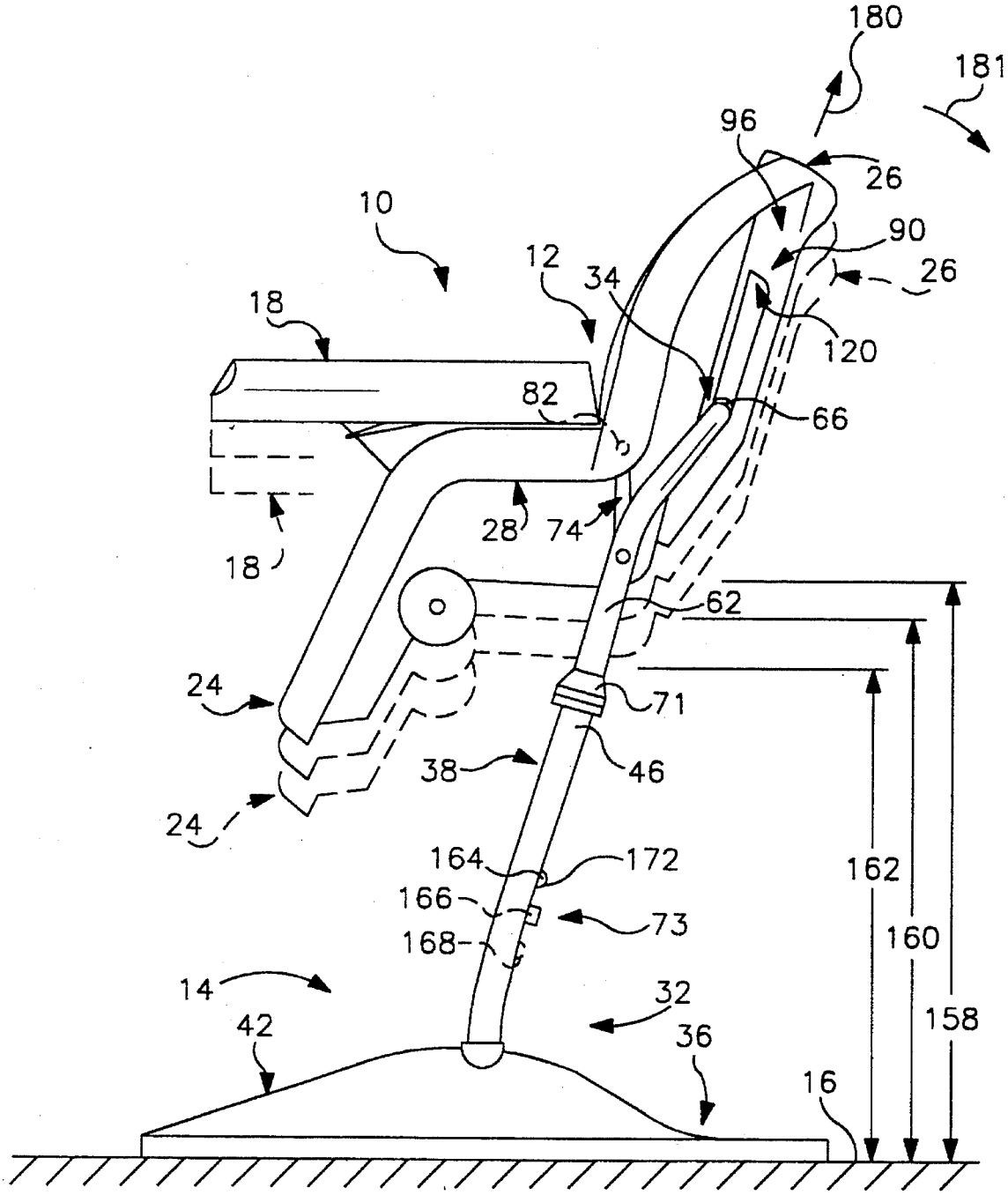
FIG. 12 is a reduced view similar to FIG. 4 showing how the elevation of the seat can be lowered from its highest position (shown in solid) toward the pedestal base to one of several selected lower positions (each shown in phantom)

Latch assembly 118 is mounted for rotation on midsection bar 66 of U-shaped frame 34 as shown, for example, in FIGS. 3, 10, and 11. Latch assembly 118 includes a latch arm 136 having a somewhat cylindrical base sleeve 138 mounted for rotation on a portion of midsection bar 66 lying in central opening 116 of frame mount assembly 90 and between first and second rails 96, 98. Latch arm 136 also includes a distal edge 140 carrying a pair of spaced-apart laterally and oppositely extending locking lugs 134 as shown in FIG. 3. A grip handle 142 is appended to base sleeve 138 as shown in FIGS. 2, 10, and 11 to enable a caregiver to grip and rotate latch assembly 118 in direction 143 about an axis of rotation 144 extending longitudinally through straight midsection bar 66 of frame 34 to disengage locking lugs 134 from a matched pair of lug-receiving notches 128, 130, or 132 formed in spaced-apart rails 96, 98 appended to seat back 26.

A coiled torsion spring 146 is mounted on midsection bar 66 to cause one tang 148 to engage seat 12 and another tang 150 to engage a flange 152 on latch arm 136 so as to yieldably bias locking lugs 134 simultaneously into engagement with one of the pairs of spaced-apart lug-receiving notches 128, 130, and 132 provided on seat back 26 upon arrival of seat 12 at one of the preset orientation positions. Once locking lugs 134 are moved to disengage middle lug-receiving notches 130 as shown in FIG. 11, a caregiver can change the orientation of seat 12 by moving seat 12 in direction 154 (solid arrow) to reach the fully reclined position shown in FIGS. 8 and 9 or in opposite direction 156 (phantom arrow) to reach the upright position shown in FIGS. 2, 4, and 5.

A height-adjustment feature of multi-position chair 10 is shown in FIGS. 12–16. By using the elevation locking means 73 noted previously, a caregiver can raise or lower seat 12 relative to base 36 to one of the three available seat heights (e.g., highest elevation 158, middle elevation 160, and lowest elevation 162) shown in FIG. 12. Each of chair legs 38, 40 is formed to include one or more height-adjustment slots such as highest slot 164, middle slot 166, and lowest slot 168. A plate 170 carrying a height-selection lug 172 is mounted inside the distal end 68 of each of frame side arms 62, 64 in the manner shown in FIGS. 13 and 14 so that lug 172 can be moved by a caregiver to fit into one of the height-adjustment slots 164, 166, 168 formed in first and second chair legs 38, 40. A pin 174 is fixed in a transverse position inside a passageway 176 formed in each of frame side arms 62, 64 to hold plate 170 inside passageway 176 and allow lug 172 to protrude from each of side arms 62, 64 through a slot 178 formed in the distal end 72 so that lug 172 can engage one of the height-adjustment slots 164, 166, 168.

In use, to lower the elevation of seat 12 relative to underlying base 36, a caregiver must first lift and rock seat 12 slightly in directions 180, 181 (FIG. 12) to lift frame side arms 62, 64 in direction 182 and tilt distal end 68 in direction 183 inside passageway 70 as shown in FIGS. 13 and 15 to disengage height-selection lug 172 from, for example, highest slot 164. Then seat 12 can be lowered toward base 36 to cause lug 172 to move downwardly in direction 184 toward underlying middle slot 166 as shown in FIG. 16. Gravity forces will cause lug 172 to "fall" into the next available height-adjustment slot (e.g., middle slot 166) due to the inclined angle 41 of chair legs 38, 40 shown, for example, in FIG. 4.

Lug 172 also includes an upwardly facing inclined ramp 185 which functions to cam lug 172 on frame side arm 62 or 64 in direction 186 (see FIG. 16) so as to disengage lug 172 from one of slots 164, 166, 168 automatically whenever a caregiver desires to raise seat 12 to a higher elevation. In use, to raise the elevation of seat 12 relative to underlying base 36, a caregiver must first lift seat 12 in direction 180 to cam lugs 172 against an edge on frame side arms 62, 64 to a position disengaging the height-adjustment slot and placing the lugs 172 just above the seat-adjustment slots corresponding to the chosen new elevation of seat 12. Then, as before, seat 12 can be lowered toward base 36 to cause lugs 172 to move downwardly in direction 184 toward the chosen height-adjustment slots. Again, gravity forces will cause lugs 172 to fall into the chosen height-adjustment slots so that frame 34 is anchored to pedestal 32 at the correct height.

Figure 17:
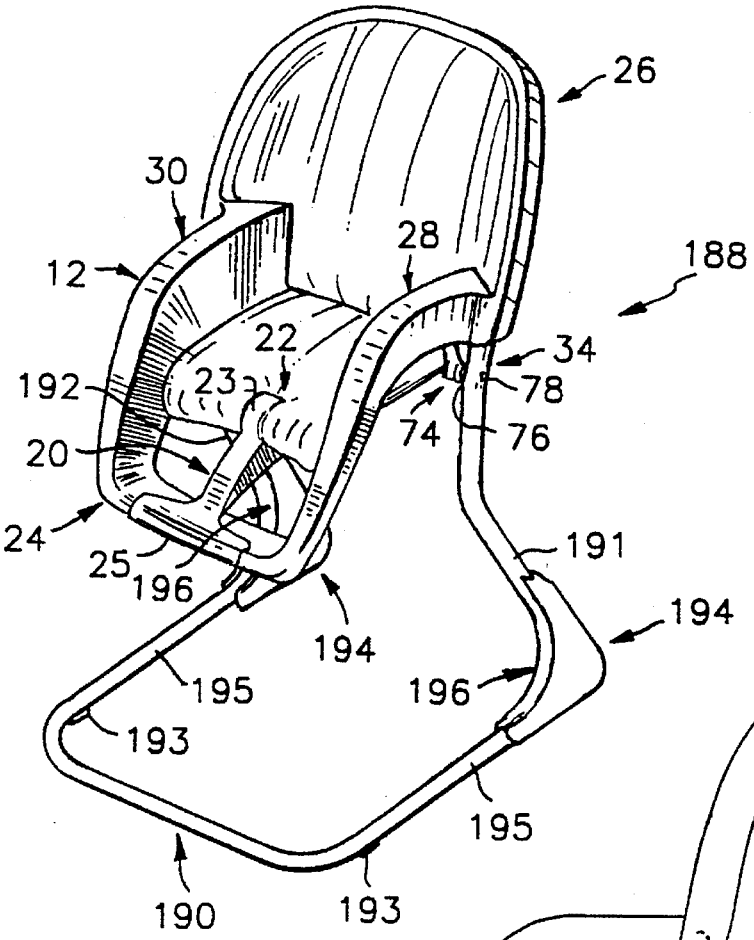
FIG. 17 is a front perspective view of a multi-position chair in accordance with another embodiment of the present invention.
Figure 18:
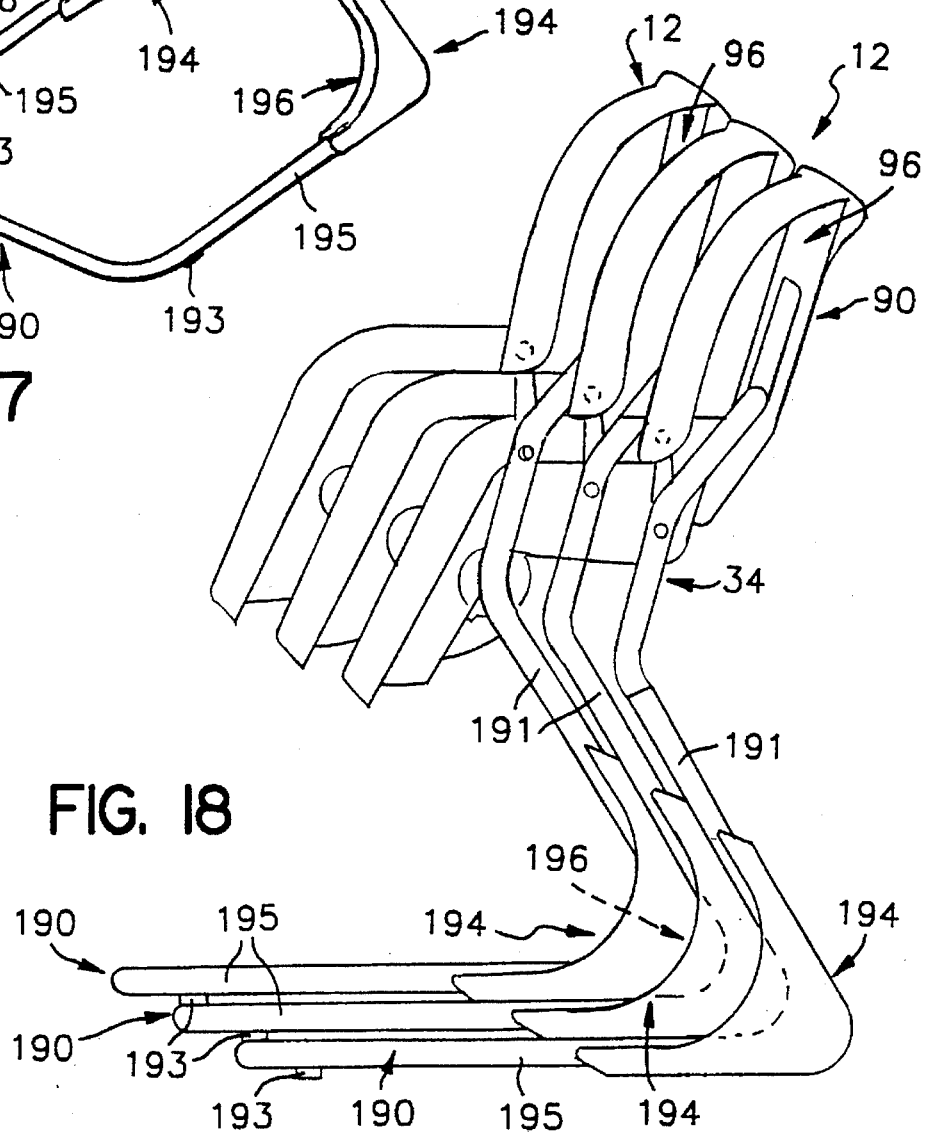
FIG. 18 is a side elevational view of three chairs of the type shown in FIG. 17 stacked one on another in nested relation.

A multi-position chair 188 suitable for use in commercial environments in accordance with another embodiment of the invention is shown in FIGS. 17 and 18. Chair 188 includes seat 12, child-restraint bar 20, and the same mechanism shown in chair 10 for changing the orientation of seat 12 between upright, mid-range, and fully reclined positions. The only features lacking in chair 188 are a removable tray and means for changing the elevation of seat 12. In many restaurants and other commercial environments, a tray is not required since the chair will often be pulled to a position alongside a table (not shown). In addition, a seat height-adjustment feature may not be required.

Chair 188 includes a simple pedestal 189 made up of a U-shaped tubular base 190 and an upright chair leg 191, 192 appended to each of the free ends of U-shaped base 190. Illustratively, base 190 and legs 191, 192 are formed of a single metal tubular member. Illustratively, base 190 includes a pair of floor pads 193 and a pair of support shoes 194 molded of plastics material and mounted to elbow joints connecting each leg 195 of base 190 to one of the chair legs 191, 192. As shown in FIG. 17, pedestal 189 is of sturdy construction suitable for use in demanding commercial environments.

One advantage of chair 188 is that it is easily stacked with other chairs 188 in the manner shown in FIG. 18. This is a welcome feature for proprietors of commercial venues needing to provide high chairs to the public but also wanting to conserve scarce floor space. Essentially, each support shoe 194 is formed to include a cavity 196 shown in FIG. 17 for receiving a nose of the support shoe of an overlying chair 188 in nested relation as shown in FIG. 18. The shape of the tubing forming upper U-shaped frame 34 and lower pedestal 189 is selected to enhance nesting of stackable chairs 188 as shown in FIG. 18.

Although the invention has been described in detail with reference to certain preferred embodiments, variations and modifications exist within the scope and spirit of the invention as described and defined in the following claims.

I claim:

1. A chair comprising a seat having a seat bottom and a seat back positioned to lie adjacent to the seat bottom, the seat back being formed to include a guide channel, and a frame assembly supporting the seat in a selected elevated position above a floor underlying the seat and the frame assembly, the frame assembly including a pedestal, a frame coupled to the pedestal and arranged to pass through the guide channel, at least one seat support link having one end pivotably coupled to the frame and another end pivotably coupled to the seat to allow the seat to move relative to the frame between selected positions, and a latch assembly releasably coupling the seat back to the frame to block pivoting and sliding movement of the frame in the guide channel and relative to the seat back and pivoting movement of each seat support link relative to the seat and frame.

2. The chair of claim 1, wherein the seat back includes an occupant-engaging portion facing in a forward direction toward the seat bottom, a rear wall portion facing in a rearwardly direction away from the seat bottom, and a frame mount assembly appended to the rear wall portion and formed to include the guide channel.

3. The chair of claim 2, wherein the frame mount assembly is formed to include a pair of spaced-apart rails appended to the rear wall portion of the seat back, each rail is formed to include an elongated slot, and the elongated slots cooperate to define the guide channel and receive a portion of the frame for sliding and pivoting movement therein.

4. The chair of claim 3, wherein the latch assembly is positioned to lie between the pair of spaced-apart rails.

5. The chair of claim 3, wherein the seat back is formed to include a lug-receiving notch corresponding to each of the selected positions of the seat relative to the frame and the latch assembly includes a latch arm mounted for rotation on said portion of the frame and formed to include a locking lug, a spring biasing the locking lug into a lug-receiving notch upon arrival of the seat at one of the selected positions of the seat relative to the frame to block movement of the seat relative to the frame, and a latch handle for rotating the latch arm about said portion of the frame against the spring to disengage the locking lug and the lug-receiving notch to allow movement of the seat and each seat support link relative to the frame.

6. The chair of claim 2, wherein said another end of each seat support link is pivotably coupled to a pivot post appended to the rear wall portion of the seat back.

7. The chair of claim 6, wherein the frame assembly includes a pair of seat support links positioned to lie in spaced-apart relation so that the frame mount assembly and the latch assembly lie therebetween.

8. The chair of claim 1, wherein the seat back is formed to include a spaced-apart pair of bar-receiving slots, the frame includes a first arm coupled to the pedestal, a second arm coupled to the pedestal, and a midsection bar interconnecting the first and second arms and passing through the pair of bar-receiving slots formed in the seat back for sliding and pivoting movement therein during movement of the seat relative to the frame.

9. The chair of claim 8, wherein the latch assembly is mounted for rotational movement on a portion of the midsection bar lying between the two slots formed in the seat back and the latch assembly is rotatable about the midsection bar between a seat back-engaging position blocking movement of the seat relative to the frame and a seat back-disengaging position allowing movement of the seat relative to the frame.

10. The chair of claim 9, wherein the seat back is formed to include a lug-receiving notch corresponding to each of the selected positions of the seat relative to the frame and the latch assembly includes a latch arm mounted for rotation on said portion of the frame and formed to include a locking lug, a spring biasing the locking lug into a lug-receiving notch upon arrival of the seat at one of the selected positions of the seat relative to the frame to block movement of the seat relative to the frame, and a latch handle for rotating the latch arm about said portion of the frame against the spring to disengage the locking lug and the lug-receiving notch to allow movement of the seat and each seat support link relative to the frame.

11. The chair of claim 8, wherein the pedestal includes a base and first and second upright chair legs mounted on the base and arranged to lie in spaced-apart relation, and the first arm includes a distal portion coupled to the first upright chair leg and the second arm includes a distal portion coupled to the second upright chair leg to support the seat in an elevated position above the base.

12. The chair of claim 11, wherein the frame assembly includes first and second seat support links positioned to lie in spaced-apart relation, said one end of the first seat support link is pivotably coupled to the first arm of the frame, said another end of the first seat support link is pivotably coupled to a first pivot post appended to the seat back, said one end of the second seat support link is pivotably coupled to the second arm of the frame, and said another end of the second seat support link is pivotably coupled to a second pivot post appended to the seat back and arranged to lie in spaced-apart relation to the first pivot post.

13. The chair of claim 8, wherein the pedestal includes a base and first and second upright chair legs mounted on the base and arranged to lie in spaced-apart relation, the first arm includes a distal portion slidably coupled to the first upright chair leg, the second arm includes a distal portion slidably coupled to the second upright chair leg, and the chair further comprises means for locking each of the first and second arms in the fame to one of first and second upright chair legs in the pedestal to fix the seat in a selected elevated position above the base.

14. The chair of claim 13, wherein each of the first and second upright chair legs is formed to include at least two spaced-apart height-adjustment slots and the locking means includes a height-selection tab appended to the distal portion of each of the first and second arms and arranged to engage any of the height adjustment slots to establish the selected elevated position of the seat above the base.

* * * * *